US005607827A

United States Patent [19]

Kirk et al.

[11] Patent Number: 5,607,827

[45] Date of Patent: Mar. 4, 1997

[54] SILVER HALIDE PHOTOGRAPHIC MATERIAL COMPRISING PYRIDINIUM CARBAMOYL HARDENERS

[75] Inventors: Mark P. Kirk, Bishop's Stortford, United Kingdom; Stefano Parodi, Savona; Paolo Vacca, Vado Ligure, both of Italy

[73] Assignee: Minnesota Mining & Manufacturing, St. Paul, Minn.

[21] Appl. No.: 531,714

[22] Filed: Sep. 21, 1995

[30] Foreign Application Priority Data

Oct. 31, 1994 [EP] European Pat. Off. ..... 94117150

[51] Int. Cl.[6] ..... G03C 1/035; G03C 1/30

[52] U.S. Cl. ..... 430/567; 430/623; 430/642

[58] Field of Search ..... 430/623, 567, 430/642

[56] References Cited

U.S. PATENT DOCUMENTS

| | | | |
|---|---|---|---|
| 4,063,952 | 12/1977 | Himmelmann et al. | 430/623 |
| 4,973,547 | 11/1990 | Schmidt | 430/567 |

FOREIGN PATENT DOCUMENTS

| | | | |
|---|---|---|---|
| 0576910A1 | 1/1994 | European Pat. Off. . | |
| 2282125 | 3/1976 | France . | |
| 2168132 | 7/1987 | Japan | 430/623 |
| 3226734 | 10/1991 | Japan | 430/623 |

OTHER PUBLICATIONS

"Photographic Silver Halide Emulsions, Preparations, Addenda, Processing and Systems," Research Disclosure, Dec., 1989, pp. 993–1015.

*Primary Examiner*—Lee C. Wright

*Attorney, Agent, or Firm*—Gary L. Griswold; Walter N. Kirn; Gregory A. Evearitt

[57] ABSTRACT

The present invention relates to a silver halide photographic material comprising a support and at least one silver halide emulsion layer coated thereon, wherein said silver halide photographic material comprises tabular silver halide grains having an average aspect ratio higher than 3:1 dispersed in highly deionized gelatin, and a pyridinium carbamoyl hardener having the following formula:

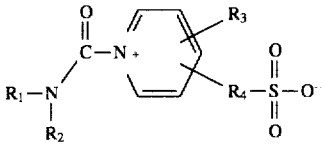

wherein $R_1$ and $R_2$ each independently represents an alkyl group having from 1 to carbon atoms, an aryl group having from 6 to 15 carbon atoms, an aralkyl group having from 7 to 15 carbon atoms, or $R_1$ and $R_2$ together form the atoms required to complete a heterocyclic ring, $R_3$ represents a hydrogen atom, a halogen atom, an alkyl group having from 1 to 10 carbon atoms, an alkoxy group having from 1 to 10 carbon atoms, a carbamoyl group, a ureido group, and $R_4$ represents an alkylene group having from 1 to 4 carbon atoms or a single chemical bond.

7 Claims, No Drawings

SILVER HALIDE PHOTOGRAPHIC MATERIAL COMPRISING PYRIDINIUM CARBAMOYL HARDENERS

FIELD OF THE INVENTION

The present invention relates to silver halide photographic materials. In particular the invention relates to the use of a carbamoyl pyridinium hardener in a silver halide photographic material comprising tabular silver halide grain emulsion(s) and highly deionized gelatin. The invention provides a photographic material having better sensitometric and physical properties.

BACKGROUND OF THE INVENTION

It is known that the mechanical properties of gelatin containing layers of photographic materials can be improved by addition of a hardening agent. In fact, photographic materials are usually stored at elevated temperatures and humidity conditions or treated with various aqueous solutions having different pH and temperatures, and gelatin layers which have not been treated with a hardening agent have poor water resistance, heat resistance and abrasion resistance.

Many compounds are known to be effective for increasing mechanical resistance of a gelatin layer by hardening. They include, for example metal salts such as chromium, aluminium and zirconium salts; aldehydes such as formaldehyde and glutaraldehyde; halogenocarboxylaldehydes such as mucochloric acid; aziridine compounds such as those described in U.S. Pat. No. 3,017,280; epoxy compounds such as those described in U.S. Pat. No. 3,091,537; halogenotriazine compounds such as hydroxydichlorotriazine and aminodichlorotriazine; and compounds having vinylsulfonyl groups such as methylene-bis-vinylsulfone, divinylsulfone and methylene-bis-vinylsulfonamide.

A group of hardening agents for photographic gelatin-containing layers which is particularly interesting has been disclosed in U.S. Pat. No. 4,063,952. These hardening agents are carbamoyl pyridinium compounds in which the pyridine ring carries a sulfo or sulfoalkyl group. These compounds have high water solubility, a fast hardening action for gelatin, and low occurrence of post-hardening (post-hardening is a change in the degree of hardening caused by slow continued hardening of the gelatin). They belong to the group of "quick-acting" hardeners with which light-sensitive photographic materials can be hardened to an optimum degree within a very short time.

JP 05/265,115 describes a silver halide photographic material comprising tabular grain emulsions, a carbamoyl pyridinium hardener and at least one erythritol compound to improve the covering power and sensitivity in rapid processing.

EP 578,191 discloses the use of pyridinium hardener in combination with copolymers based on acrylamide and sulfoalkylacrylamide monomers in silver halide photographic materials to improve the coatability of the silver halide emulsion layer(s).

JP 05/119,427 describes a silver halide photographic material comprising at least one trisubstituted triazine and at least one pyridinium sulfonate in emulsion and/or hydrophilic layer to improve the storage stability at high temperatures of the photographic material.

However, when the carbamoyl pyridinium hardeners are used with conventionally known silver halide photographic elements, i.e, photographic elements comprising isometric (cubic, octahedral, end the like) silver halide grains and/or conventional gelatin, they give unsatisfactory results. In particular, the physical properties of roller marking and hard mottle were worse than those obtained with conventional hardener, and there was no additional benefit in terms of sensitometric results.

SUMMARY OF THE INVENTION

The present invention relates to a silver halide photographic material comprising a support and at least one silver halide emulsion layer coated thereon, wherein said silver halide photographic material comprises tabular silver halide grains having an average aspect ratio higher than 3:1 dispersed in highly deionized gelatin, and a pyridinium carbamoyl hardener.

DETAILED DESCRIPTION OF THE INVENTION

Accordingly, the present invention relates to a silver halide photographic material comprising a support and at least one silver halide emulsion layer coated thereon, wherein said silver halide photographic material comprises tabular silver halide grains having an average aspect ratio higher than 3:1 dispersed in highly deionized gelatin, and a pyridinium carbamoyl hardener.

After an extensive experimentation, it has been unexpectedly found that the combination of the present invention does not give the aforementioned disadvantages of the prior art. In particular the physical properties of the material of the present invention were comparable or even better than those obtained with conventional hardeners. Moreover, the sensitometric results of the silver halide photographic material of the present invention were substantially improved.

The carbamoyl pyridinium hardeners of the present invention correspond to the general formula:

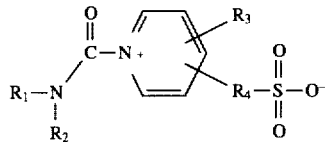

wherein:

$R_1$ and $R_2$ (which may be the same or different) each represents an alkyl group having from 1 to 10 carbon atoms (e.g., methyl, ethyl, 2-ethylhexyl), an aryl group having from 6 to 15 carbon atoms (e.g., phenyl, naphthyl), an aralkyl group having from 7 to 15 carbon atoms (e.g., benzyl, phenethyl), or $R_1$ and $R_2$ together form the atoms required to complete a heterocyclic ring (e.g., pyrrolidine, morpholine, piperidine, piperazine, 1,2,3,4-tetrahydroquinoline ring, etc.)

$R_3$ represents a hydrogen atom, a halogen atom, an alkyl group having from 1 to 10 carbon atoms (e.g., methyl, ethyl), an alkoxy group having from 1 to 10 carbon atoms, a carbamoyl group, a ureido group, and $R_4$ represents an alkylene group having from 1 to 4 carbon atoms (e.g., methylene, ethylene, propylene) or a single chemical bond.

When the term "group" or "ring" is used in the present invention, the described chemical material includes the basic group or ring and that group or ring with conventional substituents. Where the term "moiety" is used to describe a chemical compound or substituent, only an unsubstituted chemical material is intended to be included. For example, "alkyl group" includes not only such alkyl moieties as methyl, ethyl, octyl, stearyl, etc. but also such moieties bearing substituents groups such as halogen, cyano, hydroxyl, nitro, amine, carboxylate, etc. On the other hand, "alkyl moiety" includes only methyl, ethyl, octyl, stearyl, cyclohexyl, etc.

Practical examples of carbamoyl pyridinium compounds are shown hereinbelow, but the invention is not limited to these compounds and includes the pyridinium compounds described in the prior art earlier discussed.

H-1

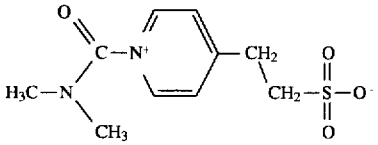

H-2

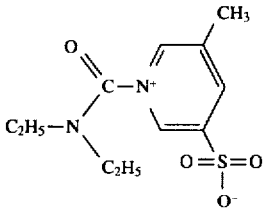

H-3

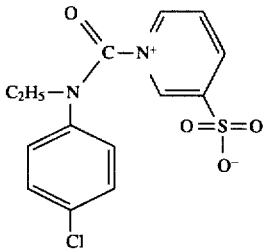

H-4

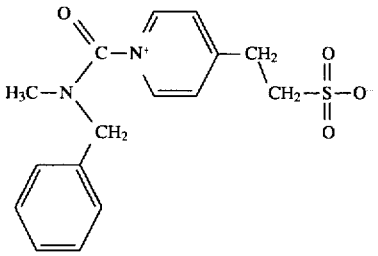

H-5

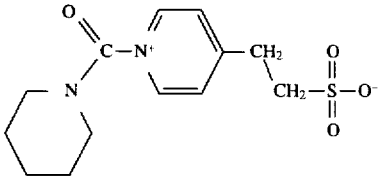

H-6

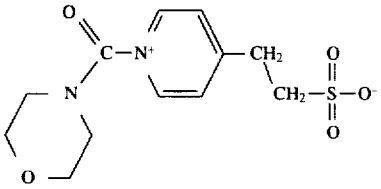

-continued

H-7

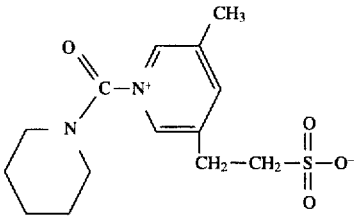

H-8

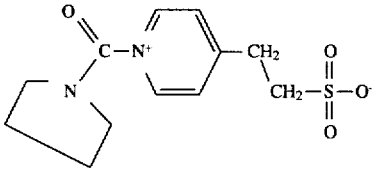

H-9

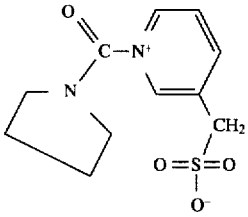

H-10

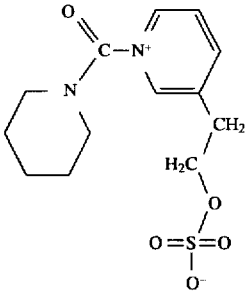

H-11

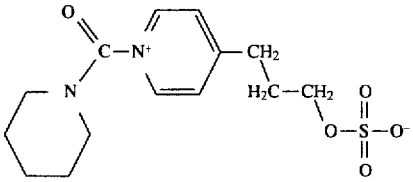

H-12

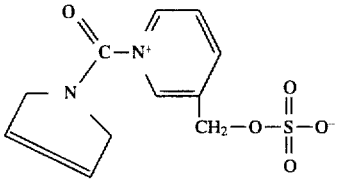

H-13

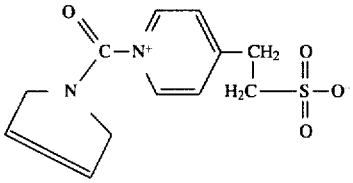

H-14

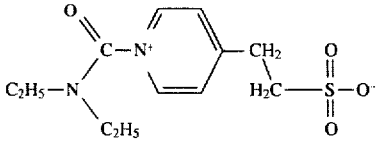

The carbamoyl pyridinium hardeners of the present invention can be added to the silver halide photographic emulsion or to another light-insensitive additional layer, such as, for example, the top-coat layer, the antistatic layer, and the like. According to a preferred embodiment of the present invention, the carbamoyl pyridinium hardener is added both to the emulsion and to the top-coat layer.

The carbamoyl pyridinium hardeners is added in a total amount of from 20 to 500 mg/m$^2$, preferably from 80 to 200 mg/m$^2$.

The highly deionized gelatin which can be used for the purposes of the present invention is characterized by a higher deionization with respect to commonly used photographic gelatins. Highly deionized gelatin is a material commercially available and well understood by one of order skill in the art. Useful highly deionized gelatin for the purpose of the present invention is sold by Rousselot Co. (France). In its broadest sense, highly deionized gelatin can be defined as gelatin having fewer than 50 ppm of calcium ion. Highly deionized gelatin can also contain reduced amounts of anionic materials as well as the lower amount of calcium ion. When initially added to the photographic system, the highly deionized gelatin can have fewer than 50 ppm of any anionic materials, preferably fewer than 5 ppm anionic materials, such as, for example, chlorides, phosphates, sulfates and nitrates. The content of these anionic materials may well change during the photographic film manufacturing process, due to the addition of photographic addenda in form of soluble salts. The calcium ion content of the final photographic film can change as well. Commonly used photographic gelatins have up to 5,000 ppm of $Ca^{++}$ ions and the significant presence of anions (higher than 1000 ppm). When the final photographic film comprises less than 1500 ppm of $Ca^{++}$, preferably less than 1000 ppm of $Ca^{++}$, and more preferably less than 500 ppm of $Ca^{++}$, the gelatin which was added to the emulsion during manufacture was deionized gelatin according to the practice of the present invention.

The highly deionized gelatin must be employed in the silver halide emulsion layers containing tabular silver halide grains, but can also be present in other component layers of the photographic element, such as silver halide emulsion layers containing other than tabular silver halide grains, overcoat layers, interlayers and layers positioned beneath the emulsion layers. In the present invention, preferably at least 50%, more preferably at least 70% of the total hydrophilic colloid of the photographic element comprises highly deionized gelatin. The amount of gelatin employed in the light-sensitive photographic material of the present invention provides a total silver to gelatin ratio equal to or lower than 1 (expressed as grams of Ag/grams of gelatin). In particular the silver to gelatin ratio of the silver halide emulsion layers is in the range of from 1 to 1.5.

The tabular silver halide grains contained in the silver halide emulsion layers of this invention have an average diameter:thickness ratio (often referred to in the art as aspect ratio) of at least 3:1, preferably 3:1 to 20:1, more preferably 3:1 to 14:1, and most preferably 3:1 to 8:1. Average diameters of the tabular silver halide grains suitable for use in this invention range from about 0.3 to about 5 micrometers, preferably 0.5 to 3 micrometers, more preferably 0.8 to 1.5 micrometers. The tabular silver halide grains suitable for use in this invention have a thickness of less than 0.4 micrometers, preferably less than 0.3 micrometers and more preferably less than 0.2 micrometers.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains of the invention, at least 15%, preferably at least 25%, and, more preferably, at least 50% of the silver halide grains are tabular grains having an average diameter:thickness ratio of not less than 3:1. Each of the above proportions, "15%", "25%" and "50%" means the proportion of the total projected area of the tabular grains having a diameter:thickness ratio of at least 3:1 and a thickness lower than 0.4 micrometers, as compared to the projected area of all of the silver halide grains in the layer. Other conventional silver halide grain structures such as cubic, orthorhombic, tetrahedral, etc. may make up the remainder of the grains.

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5% mol silver iodide. The halogen composition of individual grains may be homogeneous or heterogeneous.

Silver halide emulsions containing tabular silver halide grains can be prepared by various processes known for the preparation of photographic materials. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No. 2 (1962), pp.121–125, in Gutoff, "Nucleation and Growth Rates During the Precipitation of Silver Halide Photographic Emulsions", Photographic Science and Engineering, Vol. 14, No. 4 (1970), pp. 248–257, in Berry et al., "Effects of Environment on the Growth of Silver Bromide Microcrystals", Vol. 5, No. 6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

In preparing the silver halide emulsions containing tabular silver halide grains, a wide variety of hydrophilic dispersing agents for the silver halides can be employed in addition to the highly deionized gelatin. Gelatin as described hereinbefore is preferred, although other colloidal materials such as gelatin derivatives, colloidal albumin, cellulose derivatives or synthetic hydrophilic polymers can be used as known in the art.

The silver halide emulsions containing tabular silver halide grains used in the present invention can be chemically and optically sensitized by known methods. The silver halide emulsion layer containing the tabular silver halide grains of this invention can contain other constituents generally used in photographic products, such as binders, hardeners, surfactants, speed-increasing agents, stabilizers, plasticizers, optical sensitizers, dyes, ultraviolet absorbers, etc., and reference to such constituents can be found, for example, in Research Disclosure, Vol. 176 (December 1978), pp. 22–28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

The light-sensitive silver halide photographic material of this invention can be prepared by coating the light-sensitive silver halide emulsion layer or layers and other auxiliary layers on a support. Examples of materials suitable for the preparation of the support include glass, paper, polyethylene-coated paper, metals, polymeric film such as cellulose nitrate, cellulose acetate, polystyrene, polyethylene terephthalate, polyethylene, polypropylene and other well known supports.

The light-sensitive silver halide photographic materials of this invention are applicable to light-sensitive photographic color materials such as color negative films, color reversal films, color papers, etc., as well as black-and-white light-sensitive photographic materials such as X-ray light-sensitive materials, lithographic light-sensitive materials, black-and-white photographic printing papers, black-and-white negative films, graphic art film, etc.

Preferred light-sensitive silver halide photographic materials according to this invention are radiographic light-sensitive materials using in X-ray imaging comprising a silver halide emulsion layer(s) coated on one surface, preferably on both surfaces of a support, preferably a polyethylene terephthalate support, wherein at least one of said silver halide emulsion layers contains tabular silver halide grains having an average diameter:thickness ratio of at least 3:1 and highly deionized gelatin hardened with the above mentioned hydroxy substituted vinylsulfonyl hardeners. Preferably, the silver halide emulsions are coated on the support at a total silver coverage in the range of 3 to 6 grams per square meter. Usually, the radiographic light-sensitive materials are associated with intensifying screens so as to be exposed to radiation emitted by said screens. The screens are made of relatively thick phosphor layers which transform the X-rays into more imaging-effective radiation such as light (e.g., visible light). The screens absorb a much larger portion of X-rays than the light-sensitive materials do and are used to reduce the X-ray dose necessary to obtain a useful image. According to their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes adsorbed on the surface of the silver halide grains as known in the art.

More preferred light-sensitive silver halide photographic materials according to this invention are radiographic light-sensitive materials which employ intermediate diameter:thickness ratio tabular grain silver halide emulsions, as disclosed in 4,425,426 and in EP Pat. Appln. 84,637.

The exposed light-sensitive materials of this invention can be processed by any of the conventional processing techniques. The processing can be black-and-white photographic processing for forming a silver image or color photographic processing for forming a dye image depending upon the purpose. Such processing techniques are illustrated for example in Research Disclosure, 17643, December 1978. Roller transport processing in an automatic processor is illustrated in U.S. Pat Nos. 3,025,779, 3,515,556, 3,545,971 and 3,647,459 and in GB 1,269,268. Hardening development can be undertaken, as illustrated in U.S. Pat. No. 3,232,761.

EXAMPLE 1

A tabular grain silver bromide emulsion (having an average diameter to thickness ratio of about 6.5:1, prepared in the presence of a deionized gelatin having a viscosity at 60° C. in water at 6.67% w/w of 4.6 mPas, a conducibility at 40° C. in water at 6.67% w/w of less than 150 μS/cm and less than 50 ppm of $Ca^{++}$) was optically sensitized to green light with a cyanine dye and chemically sensitized with sodium p-toluenethiosulfonate, sodium p-toluene-sulfinate and benzothiazoleiodoethylate. At the end of the chemical digestion, non-deionized gelatin (having a viscosity at 60° C. in water at 6.67% w/w of 5.5 mPas, a conducibility at 40° C. in water at 6.67% w/w of 1,100 μS/cm and 4,500 ppm of $Ca^{++}$) was added to the emulsion in an amount to have 83% by weight of deionized gelatin and 17% by weight of non-deionized gelatin. The emulsion, containing a wetting agent and 5-methyl-7-hydroxytriazaindolizine stabilizer, was divided into four portions. The four portions were added with the hardener indicated in Tables 1 and 2. Each portion was coated on each side of a blue polyester film support at a silver coverage of 2.2 g/m$^2$ and gelatin coverage of 1.6 g/m$^2$ per side. A non-deionized gelatin protective supercoat containing 1.1 g/m$^2$ of gelatin per side and the hardener indicated in Tables 1 and 2 was applied on each coating (films A to D). The films A to D in the form of sheets were stored for 15 hours at 50° C., exposed to X-rays exposure at 75 Kv using a pair of T8 3M Trimax™ screens and processed in a 3M Trimatic™ XP515 automatic processor, by developing for 27 seconds at 35° C. with a hardener free developing solution, then fixing for 27 seconds at 30° C. with a hardener free fixing solution, and washing with water for 22 seconds at 35° C. and drying for 22 seconds at 35° C. The ready-to-use developing and fixing bath compositions used in processing the above mentioned films are described in the following tables 3 and 4.

TABLE 1

| | | Quantity (mg/m$^2$) | |
|---|---|---|---|
| Film | Compound | Emulsion | Top-coat |
| A(C) | 1 | 25 | 23 |
| B(C) | 2 | 0 | 256 |
| C(I) | 3 | 88 | 132 |
| D(I) | 4 | 97 | 34 |

(C) = Comparison
(I) = Invention

TABLE 2

Compound 1

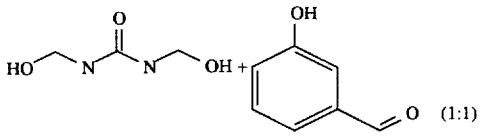

Compound 2

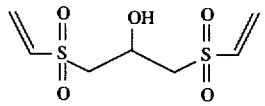

Compound 3

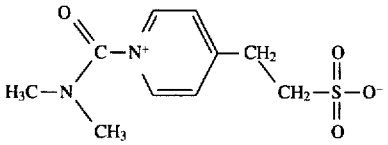

TABLE 2-continued

Compound 4

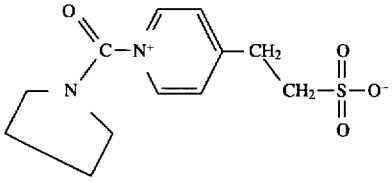

TABLE 3

| DEVELOPER | | |
|---|---|---|
| Water | g | 700 |
| $Na_2S_2O_5$ | g | 40 |
| KOH 35% (w/w) | g | 107 |
| $K_2CO_3$ | g | 13.25 |
| $CH_3COOH$ | g | 7.5 |
| Ethyleneglycol | g | 10 |
| Diethyleneglycol | g | 5 |
| EDTA.4Na | g | 1.5 |
| BUTEX ™ 5103.2Na 40% (w/w) | g | 7.5 |
| Boric acid | g | 1.7 |
| 5-methyl-benzotriazole | g | 0.08 |
| 5-nitro-indazole | g | 0.107 |
| Hydroquinone | g | 20 |
| Phenidone | g | 1.45 |
| Sodium bromide | g | 5 |
| Water to make | l | 1 |
| pH at 20° C. | | 10.35 |

TABLE 4

| FIXER | | |
|---|---|---|
| $(NH_4)_2S_2O_3$ 60% (w/w) | g | 242 |
| $Na_2SO_3$ | g | 8.12 |
| $NH_4OH$ 25% (w/w) | g | 15 |
| $CH_3COOH$ | g | 20 |
| KI | g | 0.05 |
| Water to make | l | 1 |
| pH at 20° C. | | 5.0/5.2 |

The physical and sensitometric results of films A to D are indicated in the following Table 5. The hardness was measured with a particular instrument provided with a stylus which engraves the sample imbibed with a liquid composition, water or processing solution, where it has been kept for a given temperature. The hardness values are expressed in grams loaded on the stylus to engrave the sample: the higher the weight, the harder the material.

TABLE 5

| Film | Hardness | Dmin | Dmax | Speed | Shoulder Contrast | L* | a* | b* |
|---|---|---|---|---|---|---|---|---|
| A | 50 | 0.20 | 3.80 | 2.09 | 3.73 | 82.95 | −7.04 | −11.79 |
| B | 48 | 0.195 | 3.67 | 2.07 | 3.49 | 83.01 | −6.03 | −12.21 |
| C | 40 | 0.19 | 3.99 | 2.05 | 4.00 | 83.04 | −6.81 | −12.64 |
| D | 42 | 0.19 | 3.72 | 2.01 | 3.88 | 83.45 | −6.56 | −12.41 |

The use of carbamoyl pyridinium hardeners in the material of the present invention allows the obtainment of better Dmin and Dmax values. Moreover, the overall tint characteristics are also improved having regard the comparison materials. No physical defects, such as hard mottle or roller mark, were found both in the comparison and invention samples.

The L*, a*, b* color coordinates were obtained on a Diano Matchprint scanner using a D65 light source and a 2 degrees observer angle. L*, a* and b* values are determined according the CIE (L* a* b*) method using a standard D65 illumination source. This method, identified as the CIE 1976 (L* a* b*)-Space, defines a color space where the term L* defines the perceived lightness with greater value indicating lighter tone, the term a* defines hue along a green-red axis with negative values indicating more green hue and positive values indicating more red hue, and the term b* defines hue along a yellow-blue axis with negative values indicating more blue hue and positive values indicating more yellow hue. The CIE 1976 (L* a* b*)-Space is defined by the equations:

$$L^*=116(Y/Y_n)^{1/3}-16$$

$$a^*=500[(X/X_n)^{1/3}-(Y/Y_n)^{1/3}]$$

$$B^*=200[(Y/Y_n)^{1/3}-(Z/Z_n)^{1/3}]$$

where X, Y, and Z are the CIE tristimulus values of the observed color, and Xn,Yn,Zn are tristimulus values of the standard illuminant. A more detailed description of the CIE 1976 (L* a* b*)-Space can be found in R. W. G. Hunt, *Measuring Color*, J. Wiley & Sons, New York.

The evaluation of L*a*b* measurements needs to take into account all the values at the same time. A difference higher than 0.3 is a significant value to an inexperienced human observer, a difference higher than 0.1 can be discerned by an experienced human observer. The L*, a*, b* color coordinates obtained with the radiographic material of the present invention give a colder tint (blue-green) than the comparison radiographic element. This is mainly due to the lower value of b, which is responsible of a better green hue.

EXAMPLE 2

A tabular grain silver bromoiodide emulsion having an aspect ratio of about 6:1 and average grain thickness 0.18 mm (prepared in the presence of a deionized gelatin having a viscosity at 60° C. in water at 6.67% w/w of 4.6 mPas, a conducibility at 40° C. in water at 6.67% w/w of less than 150 μS/cm and less than 50 ppm of $Ca^{++}$) was optically sensitized to green light with a cyanine dye. The emulsion was chemically sensitized with benzothiazoleiodoethylate, potassium tetrachloroaurate, sodium p-toluenethiosulfonate, and potassium chloropalladate. After each addition a pause of about one minute was conducted to homogenize the emulsion. After the addition of chemical sensitizers the emulsion was chemically ripened for about 130 minutes at 60° C. At the end of the chemical ripening, non-deionized gelatin (having a viscosity at 60° C. in water at 6.67% w/w of 5.5 mPas, a conducibility at 40° C. in water at 6.67% w/w of 1,100 μS/cm and 4,500 ppm of $Ca^{++}$) was added to the emulsion in an amount of 83% by weight deionized gelatin and 17% by weight non-deionized gelatin. At the end of the chemical ripening the emulsion, was also added with 200 mg/Agmole of KI and 1.373 g/Agmole of 5-methyl-7-hydroxytriazaindolizine stabilizer. The emulsion was divided into seven portions. The seven portions were added with the hardener indicated in Table 6. Each portion was coated on each side of a blue polyester film support at a silver coverage of 2.2 g/m$^2$ and gelatin coverage of 1.6 g/m$^2$ per side. A non-deionized gelatin protective supercoat containing 1.1 g/m$^2$ of gelatin per side and the hardener indicated in Table 6 was applied on each coating (films A to G). The films A to G in the form of sheets were stored for 15 hours at 50° C., exposed to white light and processed in a 3M Trimatic™ XP515 automatic processor, by developing for 27 seconds at 35° C. with a hardener free developing solution, then fixing for 27 seconds at 30° C. with a hardener free fixing solution, and washing with water for 22 seconds at 35° C. and drying for 22 seconds at 35° C. The ready-to-use developing and fixing bath compositions used in processing are described in the above mentioned tables 2 and 3.

TABLE 6

| Film | Compound | Quantity (mg/m$^2$) Emulsion | Top-coat |
|---|---|---|---|
| A(C) | 2 | — | 90 |
| B(I) | 3 | — | 96 |
| C(I) | 3 | 32 | 64 |
| D(I) | 4 | — | 72 |
| E(I) | 3 | — | 51 |
| F(I) | 4 | — | 56 |

The physical and sensitometric results of films A to F are indicated in the following Table 7.

TABLE 7

| Film | Hardness | Dmin | Dmax | Speed | Shoulder Contrast | L* | a* | b* |
|---|---|---|---|---|---|---|---|---|
| A(C) | 54 | 0.19 | 3.44 | 1.96 | 2.76 | 83.82 | −4.80 | −10.07 |
| B(I) | 44 | 0.19 | 3.84 | 2.05 | 3.62 | 83.42 | −5.48 | −11.46 |
| C(I) | 39 | 0.19 | 3.81 | 2.06 | 3.43 | 83.50 | −5.52 | −11.46 |
| D(I) | 35 | 0.195 | 3.96 | 2.10 | 3.63 | 83.20 | −5.34 | −11.71 |
| E(I) | 36 | 0.18 | 3.96 | 2.06 | 3.68 | 83.83 | −5.42 | −11.50 |
| F(I) | 33 | 0.185 | 3.88 | 2.05 | 3.79 | 83.65 | −5.53 | −11.74 |

The films of the present invention show a significant improvement in Dmax, shoulder contrast, and speed. Also, a better-tint is obtained as demonstrated by the evaluation of the L*a*b* values. Lower values of a* and b* mean a colder (blue-green) tint of the radiographic material which is particularly appreciated by radiologists.

We claim:

1. A silver halide photographic material comprising a support and at least one silver halide emulsion layer coated thereon, wherein said silver halide photographic material comprises tabular silver halide grains having an average aspect ratio higher than 3:1 dispersed in highly deionized gelatin, and a pyridinium carbamoyl hardener wherein said pyridinium carbamoyl hardener is represented by the following formula:

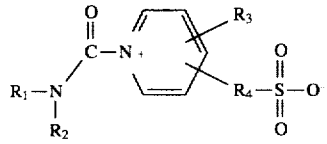

wherein:

$R_1$ and $R_2$ each independently represents an alkyl group having from 1 to 10 carbon atoms, an aryl group having from 6 to 15 carbon atoms, an aralkyl group having from 7 to 15 carbon atoms, or $R_1$ and $R_2$ together form the atoms required to complete a heterocyclic ring $R_3$ represents a hydrogen atom, a halogen atom, an alkyl group having from 1 to 10 carbon atoms, an alkoxy group having from 1 to 10 carbon atoms, a carbamoyl group, a ureido group, and $R_4$ represents an alkylene group having from 1 to 4 carbon atoms or a single chemical bond.

2. The silver halide photographic material according to claim 1 wherein said pyridinium carbamoyl hardener is added to said silver halide emulsion layer.

3. The silver halide photographic material according to claim 1 wherein said pyridinium carbamoyl hardener is added both to said silver halide emulsion layer and to an additional light-insensitive layer.

4. The silver halide photographic material according to claim 1 wherein said pyridinium carbamoyl hardener is present in an amount of from 20 to 500 $mg/m^2$.

5. The silver halide photographic material according to claim 1 wherein said pyridinium carbamoyl hardener is present in an amount of from 80 to 200 $mg/m^2$.

6. The silver halide photographic material according to claim 1 wherein said tabular silver halide grains have an average aspect ratio of from 3:1 to 8:1 and the projective area of said tabular grains covers at least 50% of the area of all the silver halide grains.

7. The silver halide photographic material according to claim 1 wherein said highly deionized gelatin comprises less than 50 ppm of $Ca^{++}$ ions.

* * * * *